US011147744B1

(12) United States Patent
Duong

(10) Patent No.: US 11,147,744 B1
(45) Date of Patent: Oct. 19, 2021

(54) DEVICE ATTACHING HANDLES AND TOYS TO A BABY BOTTLE FOR DEVELOPING DEXTERITY

(71) Applicant: Lawrence Duong, Oakland, CA (US)

(72) Inventor: Lawrence Duong, Oakland, CA (US)

( * ) Notice: Subject to any disclaimer, the term of this patent is extended or adjusted under 35 U.S.C. 154(b) by 0 days.

(21) Appl. No.: 16/927,175

(22) Filed: Jul. 13, 2020

(51) Int. Cl.
*A61J 9/06* (2006.01)

(52) U.S. Cl.
CPC ..... *A61J 9/0607* (2015.05); *A61J 9/0623* (2015.05); *A61J 9/0669* (2015.05)

(58) Field of Classification Search
CPC ..... A61J 9/0607; A61J 9/0623; A61J 9/0669
USPC ..... 215/396, 390; 220/755, 775, 758, 759; D24/199
See application file for complete search history.

(56) References Cited

U.S. PATENT DOCUMENTS 2,789,002 A * 4/1957 Nicholas ..... A61J 9/0623 294/33
2,955,382 A * 10/1960 Boles ..... A63H 33/00 446/227
3,120,974 A * 2/1964 Matson ..... B65D 23/108 294/31.2
3,275,366 A * 9/1966 Hidding ..... B65D 23/108 294/31.2
4,363,415 A * 12/1982 Rainville ..... B29C 49/54 215/396
4,902,261 A * 2/1990 Pratt ..... A61J 9/00 215/11.1
4,943,017 A * 7/1990 Ennis ..... A61J 9/0623 215/11.1
D322,025 S * 12/1991 Funston ..... D8/382
5,170,533 A * 12/1992 Barry ..... A45F 5/10 16/425
D356,161 S * 3/1995 Peterson ..... D24/199
5,413,261 A * 5/1995 Wu ..... A45F 3/14 215/396
6,913,159 B1 * 7/2005 Goldberg ..... B65D 23/106 215/395
6,938,861 B1 * 9/2005 Ballard ..... A61J 9/0607 248/104
7,661,636 B1 * 2/2010 Burke ..... B60N 2/2845 248/102

(Continued)

*Primary Examiner* — J. Gregory Pickett
*Assistant Examiner* — Niki M Eloshway
(74) *Attorney, Agent, or Firm* — The Rapacke Law Group P.A.

(57) ABSTRACT

The present invention relates to baby bottles, in particular, to removable attachment handles and toys for baby bottles with an emphasis in the development of finger strength and dexterity though haptic exploration. The backbone of the present invention is a circumferential band made with bonded elastic and rigid plastic material with two equidistant ball joints designed to flexibly sleeve over a baby bottle. Multiple attachment handles and toys have socket joints that can mate to the circumferential band's ball joints, each with a unique focus on developing manual exploration to accelerate the emergence of higher haptic senses (texture, weight, volume, hardness, etc.). The ball and socket joint allows effortless interchangeability to suit a baby's developmental age and also allows customization. Haptic procedures can be habituated as early as newborns and as often as every feeding time, all the while teaching babies how to hold a handle and baby bottle.

16 Claims, 8 Drawing Sheets

(56) References Cited

U.S. PATENT DOCUMENTS

| | | | | |
|---|---|---|---|---|
| 10,039,695 | B1 * | 8/2018 | Egan-Wyer | A61J 9/0607 |
| 2002/0124297 | A1 * | 9/2002 | Caris | A63H 33/006 2/313 |
| 2002/0162918 | A1 * | 11/2002 | Suh | A61J 9/0692 248/104 |
| 2005/0000930 | A1 * | 1/2005 | Weissberg | A61J 9/0607 215/11.6 |
| 2008/0008009 | A1 * | 1/2008 | Ishii | G11C 16/10 365/185.29 |
| 2011/0315732 | A1 * | 12/2011 | Schwartz | A45F 5/02 224/580 |
| 2013/0098932 | A1 * | 4/2013 | Hunt | A61J 9/0638 220/772 |
| 2015/0211678 | A1 * | 7/2015 | Bulka | F16M 11/06 248/229.16 |

* cited by examiner

DEVICE ATTACHING HANDLES AND TOYS TO A BABY BOTTLE FOR DEVELOPING DEXTERITY

TECHNICAL FIELD

The present embodiments relate to baby bottles, in particular, to removable handles for baby bottles with an emphasis in the development of finger strength and dexterity though haptic exploration.

BACKGROUND

A baby bottle can generally be difficult for babies to grasp and hold, especially when the bottle contains fluids. The weight of the fluid combined with the large diameter of the bottle can discourage babies or prevent babies from holding the bottle during feeding. This often leads to the parent holding the baby bottle. On the other hand, if babies are able to hold the bottle, it likely is a palm-to-palm grip, where their fingers are not involved or exercised.

Various baby bottles with integrated handles and bottles with removable handles that exist in prior art have attempted to bridge the gap of transitioning from baby bottle to bottles with handles, and to reduce the need for the parent to hold the baby bottle during feeding.

However, while previous attempts to assist babies in holding baby bottles or handles exists, there is still a need for an improved device that first grabs the baby's attention and encourages them; more specifically newborns, to reach out and touch the handle to begin hand stimulation and finger activity. Since newborns are mainly limited to primitive reflexes such as the palmar grasp reflex, early exploration of these motor skills can aid the development of haptic perception. Although simple, this seems to be an important step as it translates to more complex gripping abilities that leads to holding the baby bottle and beyond.

Encouraging a newborn to reach out to a baby bottle is the first step, but maintaining and developing this as they age is also important. Baby bottles are used from newborns to older babies, forming a wide range of motor skills. This can range anywhere from uncoordinated hand skills to securing objects between the palm and fingers to honing the pincer grip and being able to pick up smaller items. However, there are no prior art that combines baby bottles with a device that promotes finger dexterity or prior art that have bottle handles based on the baby's developmental age; whether it's larger handles or smaller complex handles.

Previous apparatus included removable handles, but mainly to remove the handles off the bottle completely and not intended for replacing it with another type of handle that may be better suited for different routines or developmental ages. The handles in prior art are typically one-piece devices that entirely detaches from the bottle and often times they come off with the lid of the bottle. They are not made for constant disconnecting and reconnecting handles. Others have the handles built into the bottle itself.

The lacking combination of a handle that encourages babies to reach out to baby bottles, customized handles for different development ages and the ease of handle removability in prior art related to this field of invention invites a new device that can bridge these gaps. The present invention overcomes current prior art disadvantages by providing a device that is able to: 1) join a baby bottle with removable attachments that encourage exploratory procedures, 2) join a baby bottle with removable attachments that come in various sizes and complexities to tailor to a baby's developmental age, and lastly 3) all of the attachments can be connected effortlessly through ball and socket joints. With these capabilities, the present invention is a device to accessorize a baby bottle with attachments that emphasize in the development of finger strength and dexterity though haptic exploration.

SUMMARY OF THE INVENTION

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

Embodiments described herein provide a bottle band and two attachments. The bottle band will be sleeved over a baby bottle during use and the attachments will be joined to the bottle band. The attachments come in forms of various handles and toys, so different combinations can be used. The bottle band has balls joints formed on opposite sides and the attachments have corresponding sockets joints formed therein, whereby each bottle band to attachment joint is a ball and socket joint, allowing rotation of the attachment. Attachments can be inserted on either side of the band and rotated 360 degrees along the perpendicular axis of the bottle.

In one aspect, A device for attaching removable handles and toys to a baby bottle is disclosed, comprising a circumferential band having a plurality of joints positioned along the circumference of the circumferential band. Each of the plurality of joints releasably engages at least one of the following: at least one handle and at least one toy attachment. The circumferential band is dimensioned to releasably engage a bottle and be retained on the bottle during feeding and interaction with the toy and/or handle.

Starting with infants, the bottle band can be joined with toy attachments to stimulate and encourage the baby to reach out and grab the toy. As hand and finger activity increases, toys can be changed out to handles. There are different handle attachments that work for different development ages and these can be interchanged with each other as well. For example, during the day, an age appropriate handle attachment could be used to promote hand activity and at night, one handle attachment can be replaced with a toy attachment, specifically a stuffed animal toy attachment, for comforting the baby to sleep while the other attachment can remain a handle. Toy attachments will also have holding places to act as a handle.

The attachments can be stand alone as well while detached from the bottle. In the previous example, if the baby is going to sleep, but wanted to continue playing with the toy stuffed animal attachment, the parent can simply detach the toy for the baby. Likewise, the handle attachments can become grasping and teething toys while detached from the bottle, allowing the present invention to be more flexible and useful even during non-feeding times.

Early exploration of the haptics can dovetail a baby's grip strength, finger articulation and dexterity. The present invention brings a new dynamic to bottle feeding, by introducing the ability to also develop their haptic perception through exploratory procedures. This can be habituated as early as newborns and as often as every feeding time. The present invention accents this development by having a large variety of attachments, each with a unique handle or toy design that focuses on a particular style of grip and haptic sense (texture, weight, volume, hardness, etc.). Ball and socket joints provide a comfortable means of disconnecting and reconnecting the attachments, allowing the present invention to keep babies curious and help them to learn how to hold a baby bottle along the way.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
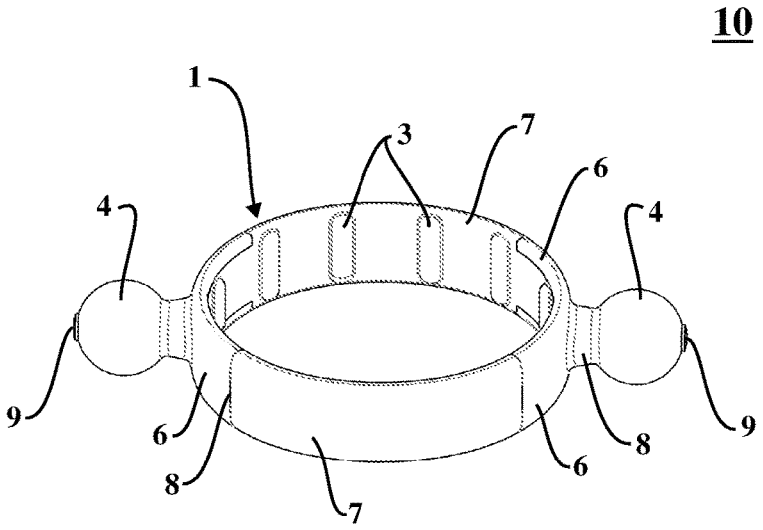
FIG. 1 is a perspective view of the bottle band in accordance with a first embodiment of the present invention.

The specific details of the single embodiment or variety of embodiments described herein are to the described apparatus. Any specific details of the embodiments are used for demonstration purposes only, and no unnecessary limitations or inferences are to be understood therefrom.

Before describing in detail exemplary embodiments, it is noted that the embodiments reside primarily in combinations of components and procedures related to the apparatus. Accordingly, the apparatus components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

The specific details of the single embodiment or variety of embodiments described herein are set forth in this application. Any specific details of the embodiments are used for demonstration purposes only, and no unnecessary limitation or inferences are to be understood therefrom. Furthermore, as used herein, relational terms, such as "first" and "second," "top" and "bottom," and the like, may be used solely to distinguish one entity or element from another entity or element without necessarily requiring or implying any physical or logical relationship, or order between such entities or elements.

Figure 2:
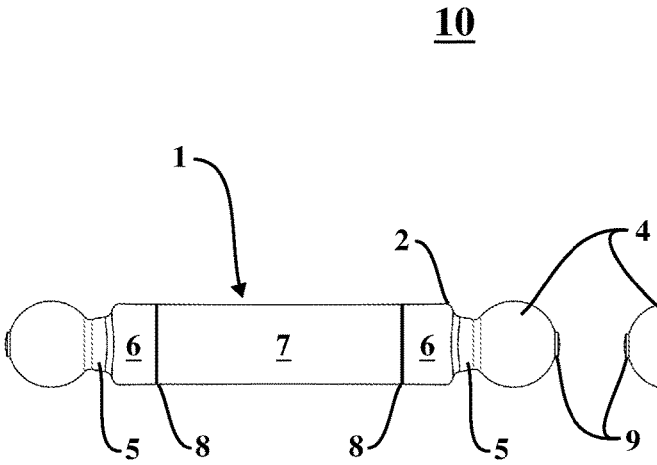
FIG. 2 is an elevation view of the bottle band from FIG. 1.
Figure 3:
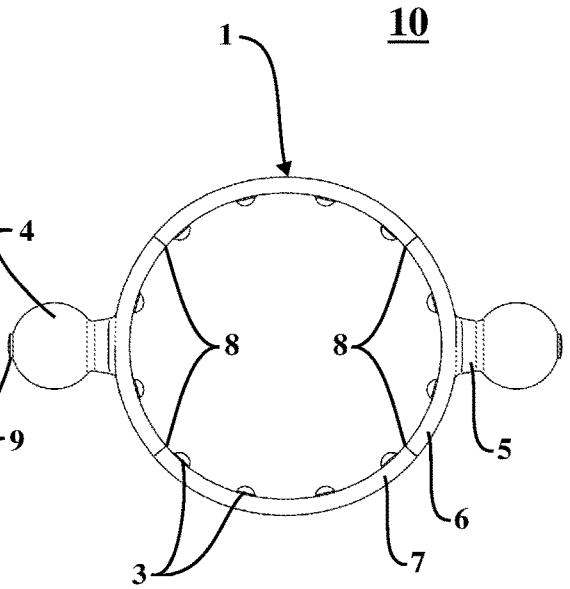
FIG. 3 is a plan view of the bottle band from FIG. 1.

FIG. 1-3 shows the first embodiment, the bottle band, depicted generally by the reference numeral 10. The band 1 is sized circumferentially to fit tightly over a baby bottle. The band 1 is bonded with two different materials, preferably a two-part mold with one part of resilient rigid plastic 6 such as polyethylene or polystyrene and the other part of flexible elastomer 7. This will allow flexibility of the band to fit a variety of baby bottles sizes. The flexible elastomer 7 will preferably be located 25% on the front of the band and 25% on the back of the band. The rigid plastic 6 will preferably be located 25% on the left side of the band and 25% on the right side of the band, both sides where the ball joints reside. The boundary where the two materials touch are a permanent bond 8. The flexible elastomer 7 will preferably also be over-molded on the inner band of the rigid plastic 6 to provide a tight friction fit and an overall cohesive look.

In some embodiments, the bottle may be constructed of a sufficiently rigid material to interface with the circumferential band 1. The circumferential band 1 is secured to the exterior of the bottle via a friction fit to allow the circumferential band to be easily applied and removed from the bottle.

In some embodiments, the circumferential band 1 is constructed of a sufficiently elastic material to allow the circumferential band 1 to expand and contract in circumference to accept various bottle dimensions.

In some embodiments, the circumferential band 1 is constructed of a thermochromic material to react to the temperature of the bottle to provide an indication of the temperature of the contents of the bottle during feeding.

The band 1 has fillet edges 2 to ease the alignment when sleeving bottle band 10 over the baby bottle. In addition, elastomer vertical ribs 3 protrude along the inside of the rigid plastic 6 of the band to lower the friction when sleeving the band over the baby bottle or adjusting the location of the band along the length or circumference of the bottle.

The outside of the band 1 has two identical ball joints 4 located 180 degrees from each other and similar in height to the height of the band. The ball joints 4 are attached to the band 1 through a conical stem 5. The purpose of the conical stem 5 is to maximize angular rotation by having a smaller footprint attachment to the ball joints 4 while not compromising the strength and durability by having a larger footprint attachment to the band 1. On the ends of the ball joints 4, there is a friction pad 9 made of flexible elastomer 7 to aid with holding the socket connector 14 in place without too much play in the connection.

FIG. 2 shows the vertical ribs 3 are spaced along the inside of the band 1.

FIG. 3 shows the curvature of the fillet edge 2.

Figure 4:
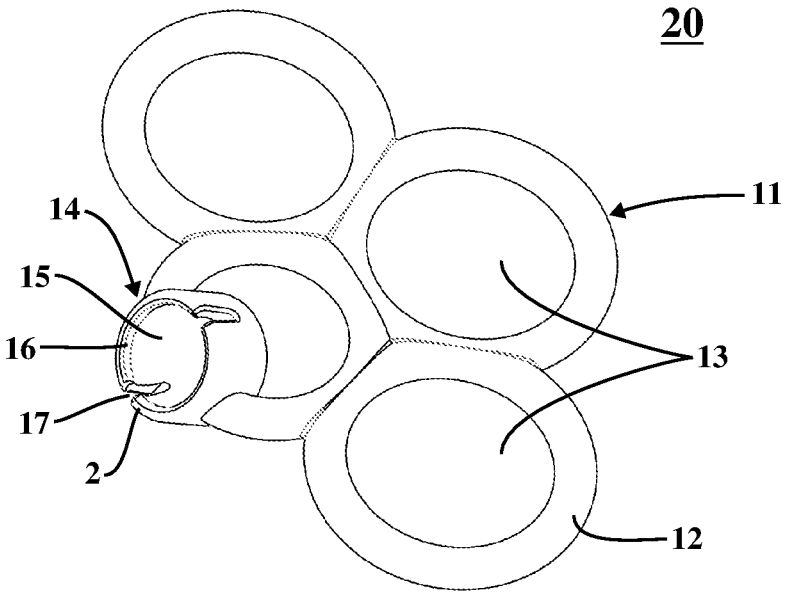
FIG. 4 is a perspective view of the attachment handle in accordance with a second embodiment of the present invention.
Figure 5:
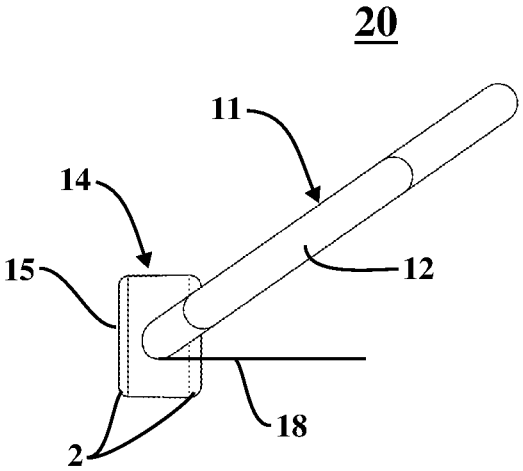
FIG. 5 is an elevation view of the attachment handle from FIG. 4.
Figure 6:
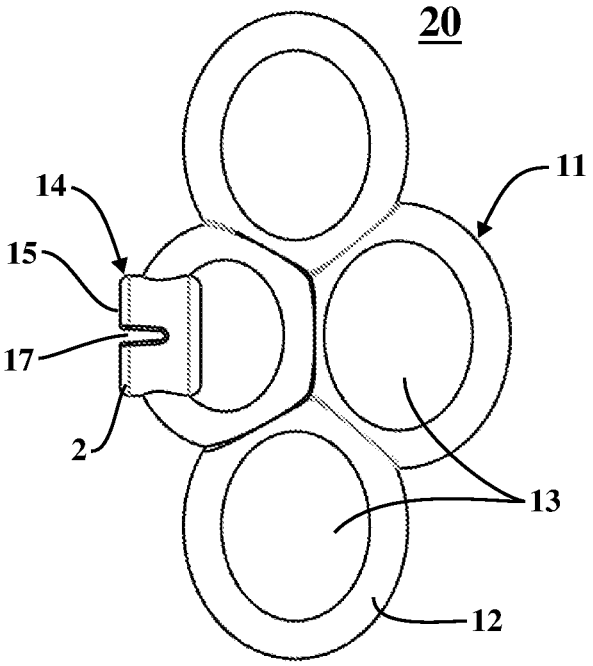
FIG. 6 is a plan view of the attachment handle from FIG. 4.

FIG. 4-6 shows the second embodiment, the preferred attachment handle, of the present invention depicted generally by the reference numeral 20. The attachment handle 20 has preferably four circular gripping arms 12 in an elliptical pattern that creates the handle 11. Each circular gripping arm 12 has an opening 13 that allows one or more fingers to reach through and grab the circular gripping arm 12 to hold the handle 11. The socket connector 14 is located on the perimeter of the middle circular gripping arms 12 with the socket end 15 facing outward. The handle 11 preferably has a handle angle 18 that is offset from the plane that is parallel with the direction of the socket connector 14. This allows the face of the handle to be more visible to insight a baby's curiosity and also create different holding patterns when attached to a baby bottle 23. Such handle visibility is shown on FIG. 4.

Each of the attachment handle embodiment within the present invention has a unique handle 11 with different gripping arms 12, however, are bound to the same socket connector 14. The socket connector 14 is cylindrical shaped with outer fillet edges 2 and one round socket end 15 to mate to the ball joint 4. The socket end 15 has a round protrusion 16 along the inner diameter of the opening to provide a secure joint with the ball joint 4 to the socket connector 14. The socket connector 14 also has two identical slots 17 that run parallel to the body of the cylinder, 180 degrees apart and start at the socket end 15 to mid-way of the socket connector 14. This allows elastic deformation of the socket connector 14 while the ball joint 4 is entering the socket without having to apply excessive force. The round depth of the socket end 15, the size of the round protrusion 16 and size of the slots 17, all create a ball and socket joint that is comfortable, fast and easy to connect and that also maximizes the angular rotation of the socket connector 14 onto the ball joint 4. The ease of the ball and socket joint encourages constant disconnect and reconnect of the various attachments which compliments the purpose of the present invention.

Figure 7:
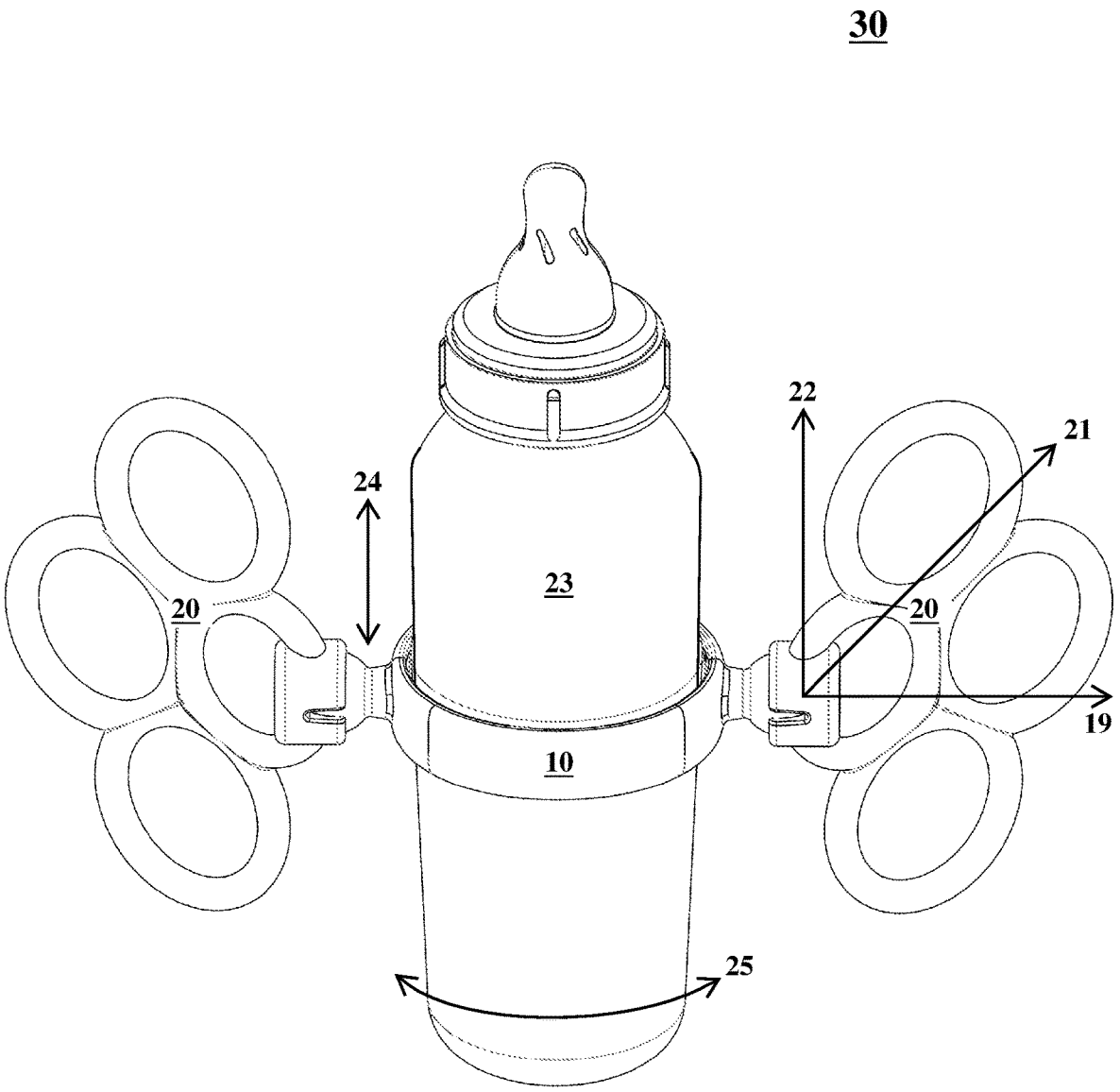
FIG. 7 is a perspective view that illustrates the bottle band FIG. 1 sleeved onto a baby bottle and also joined to the attachment handle FIG. 4.

FIG. 7 shows the first embodiment, the bottle band 10 and the second embodiment, the attachment handle 20, of the present invention, assembled together through the ball joint 4 and socket connector 14 and placed on a baby bottle 23 to visualize the intent of the present invention, is depicted generally by the reference numeral 30. The ball joint 4 and socket connector 14 allows for fluid rotation along the connection point. Independently, the attachment handle 20 can be rotated 360 degrees on the x-axis 19 and limited rotation along the y-axis 21 and z-axis 22. These boundaries are due to the ball joint 4 and socket connector 14, however, as stated earlier, these components were designed to maximize angular rotation while maintaining a secure connection.

The assembled embodiments 30 can be moved along the length of the bottle 24 and rotated along the circumference of the bottle 25 for best placement for the baby. For newborns, the assembled embodiments 30 can be placed towards the nipple of the bottle and move downwards towards the bottom of the bottle as the baby's reach and vision expands. The combination of the rotating attachment handle 20 and the ability for the assembled embodiments to move along the body of the baby bottle plays a pivotal role in providing a product that is flexible to developmental age of the baby.

The following embodiments are additional attachment handles that give the present invention a wide range of customization to tailor age appropriateness and to maintain a baby's engagement though curiosity. As described earlier, the present invention differentiates with prior art by way of having multiple attachment handles that when interchanged, can help the baby explore the haptics to develop their hand strength and dexterity. The explanation of the preferred attachment handle 20 describes how attachment handles work and its designed purpose. The following attachment handles are assumed to retain those traits, with the exception of the unique handle 11, which focuses on different gripping styles for each attachment handle.

Figure 8:
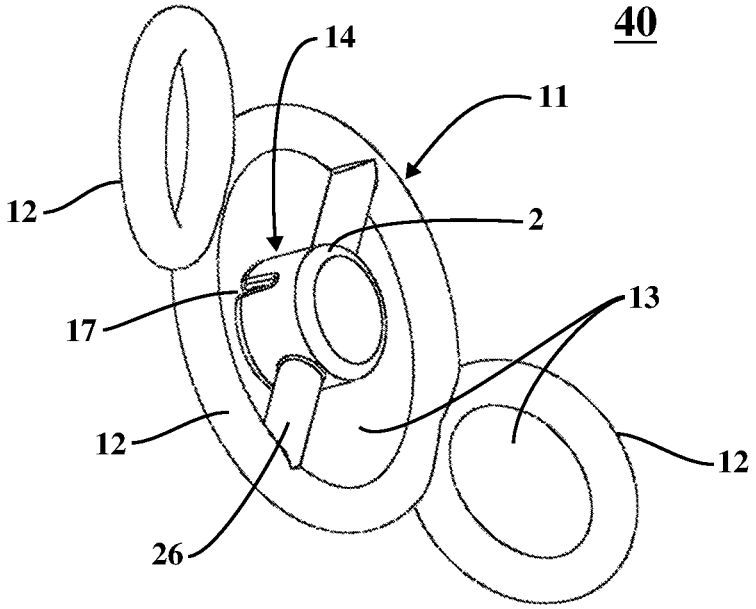
FIG. 8 is a perspective view of the attachment handle in accordance with a third embodiment of the present invention.
Figure 9:
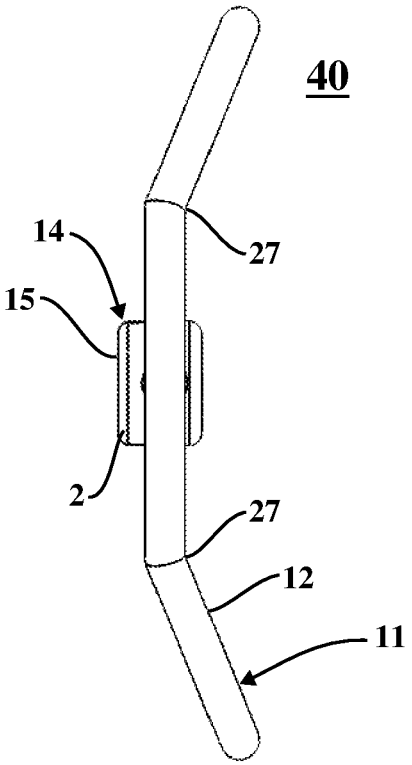
FIG. 9 is a side plan view of the attachment handle from FIG. 8.
Figure 10:
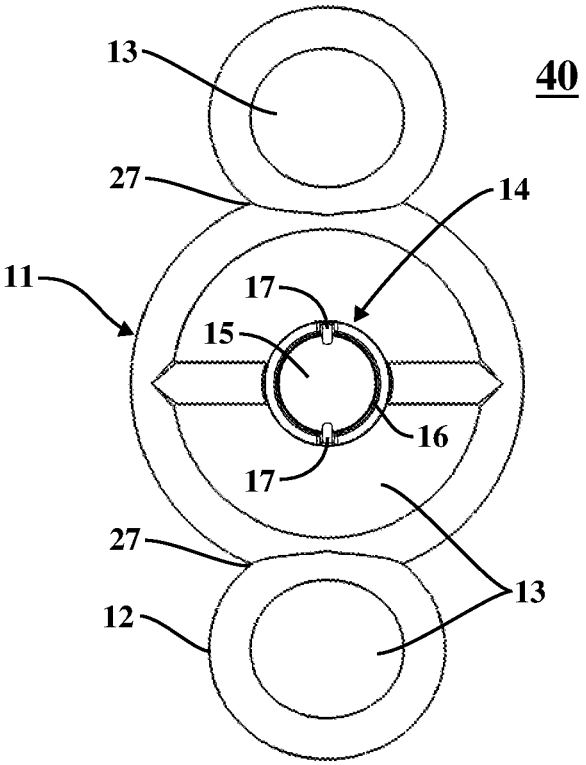
FIG. 10 is a plan view of the attachment handle from FIG. 8.

FIG. 8-10 illustrates the third embodiment, an attachment handle, of the present invention depicted generally by the reference numeral 40. The difference from this attachment handle 40 to the previous attachment handle 20 is that there are preferably three circular gripping arms 12 placed linearly. The two outer circular gripping arms 12 on opposite sides of the center circular gripping arm 12 rotate out where they intersect to create a convex 27. The socket connector 14 is secured to the center of the middle circular gripping arm 12 by straight gripping arm 26 that connects the socket connector 14 to the inner perimeter of the circular gripping arm 12. The socket end 15 faces perpendicularly to the handle 11 and facing away from the convex 27 shape of the circular gripping arms 12. The center circular gripping arm 12 has openings 13, which encourages a center grip of the socket connector 14, thereby filling the baby's palms during the grip and sprawling their fingers for another style of grip and finger placement.

Figure 11:
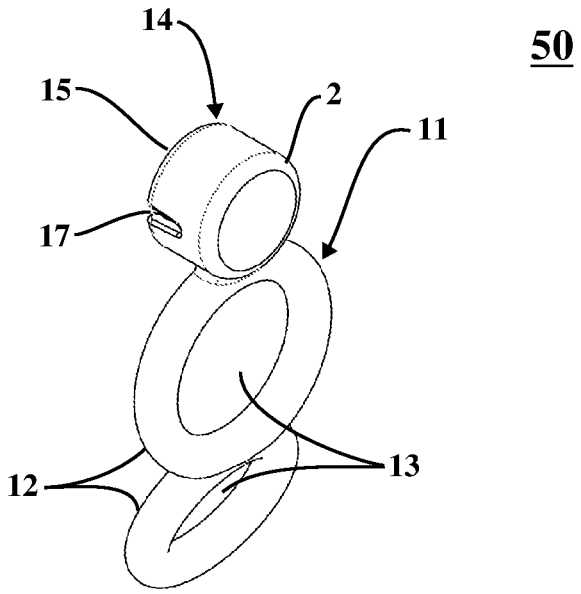
FIG. 11 is a perspective view of the attachment handle in accordance with a fourth embodiment of the present invention.
Figure 12:
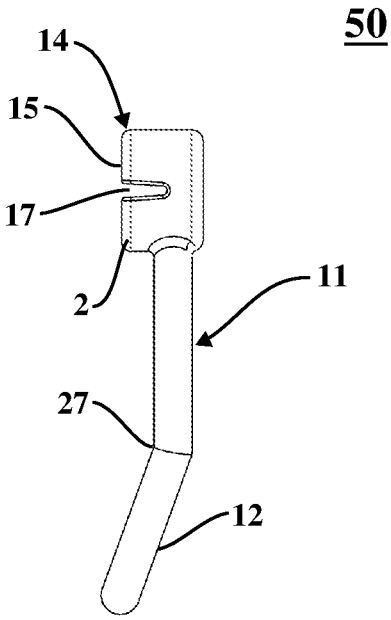
FIG. 12 is a side plan view of the attachment handle from FIG. 11.
Figure 13:
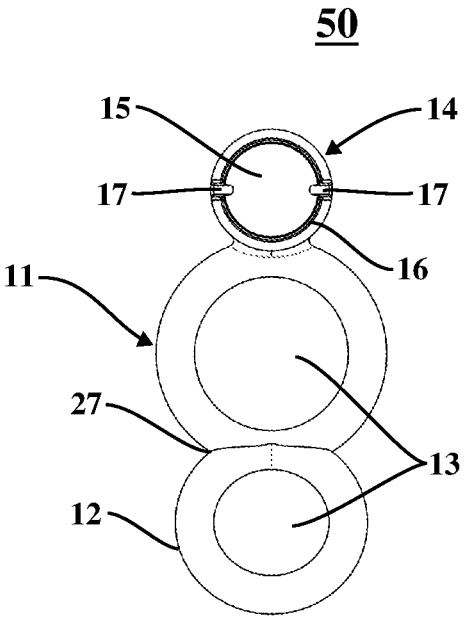
FIG. 13 is a plan view of the attachment handle from FIG. 11.

FIG. 11-13 illustrates the fourth embodiment, an attachment handle, of the present invention depicted generally by the reference numeral 50. The attachment handle 50 is similar to the attachment handle 40; however, the socket connector 14 is preferably located on one of the end circular gripping arms 12 as opposed to the center one. The circular gripping arms 12 are also much smaller than that of the third embodiment attachment handle 40; therefore, there are no straight gripping arms 26 in this attachment handle 50 due to the socket connector being attached directly to the circular gripping arm 12. In addition, the circular gripping arms 12, are attached together in a convex 27 to imitate a standard C-shaped handle grip. Along with the smaller circular gripping arms 12, this unique handle 11 allows for a volume grip that places the entire attachment handle 50 into the baby's hand.

Figure 14:
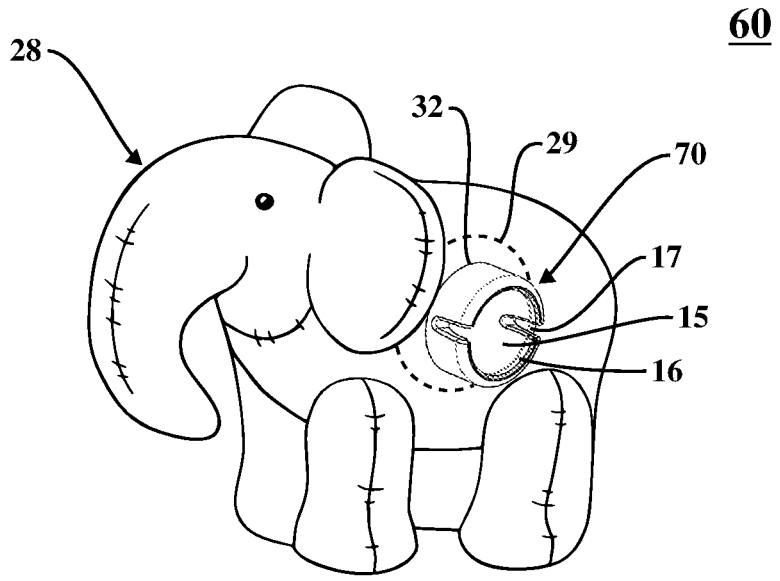
FIG. 14 is a perspective view of the attachment handle in accordance with a fifth embodiment of the present invention.
Figure 15:
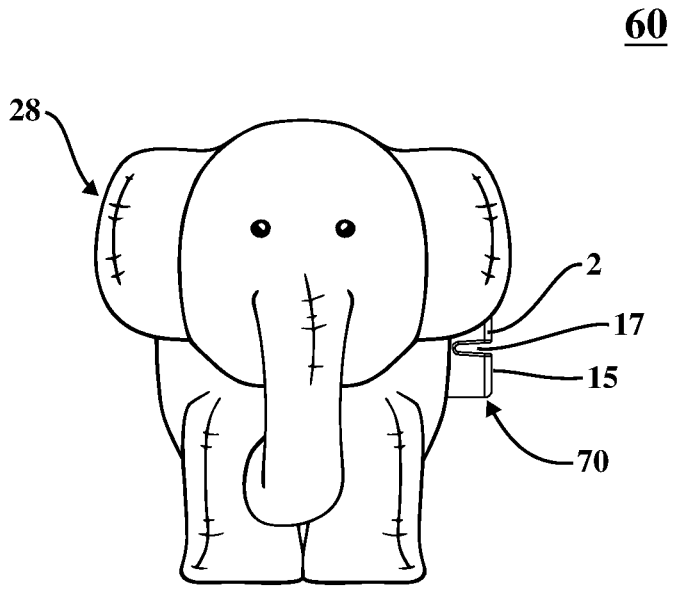
FIG. 15 is a plan view of the attachment handle from FIG. 14.

FIG. 14-15 illustrates the fifth embodiment, an attachment handle, of the present invention depicted generally by the reference numeral 60. The attachment handle 60 is a stuffed toy 28, preferably of an animal, with a specific fifth embodiment socket connector 70 preferably located on the side of the stuffed toy 28. Light weight cotton fabric and fill is the preferred material for the stuffed toy 28.

In some embodiments, the stuffed toy 28 includes one or more interactive elements, such as a musical element and/or a light element. The interactive elements may be in electrical communication with a power source and microcontroller to receive a stimulus signal from at least one sensor. For example, an accelerometer may be disposed within the stuffed toy 28 to sense movement and output a stimulus signal to the microcontroller to activate the one or more interactive elements (such as by providing lights and sounds upon movement).

In some embodiments, each toy may include at least one ball joint 4 and at least one socket connector 14 to permit the attachment of a plurality of toys in series with one another.

Figure 16:
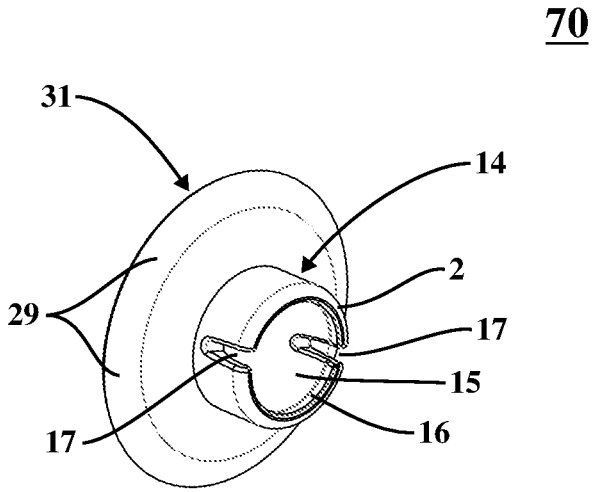
FIG. 16 is a perspective view of the socket connector specific to the attachment handle from FIG. 14.
Figure 17:
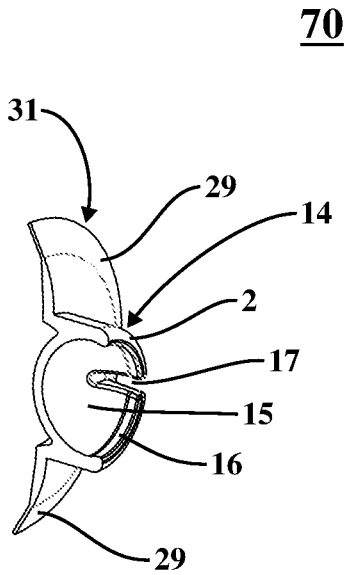
FIG. 17 is a perspective view cross section of the socket connector specific to the attachment handle from FIG. 14.
Figure 18:
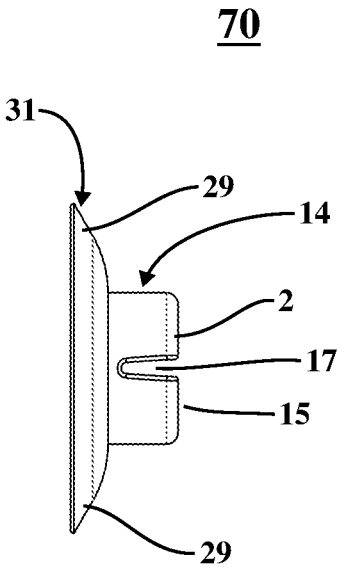
FIG. 18 is a plan view of the socket connector specific to the attachment handle from FIG. 14.

FIG. 16-18 illustrates the fifth embodiment socket connector 70, which is comprised of a socket connector 14 with a sewing channel 29 along a round base 31. The round base 31 is wide to allow enough material to comfortably pull the fifth embodiment socket connector 70 along with the attachment handle 60 off of the bottle band 10. The stuffed toy 28 will have a circular cutout 32 on the outer material for the socket connector 14 to protrude through from the inside, while the round base 31 and sewing channel 29 remains inside the stuffed toy 28. The sewing channel 29 is designed of thinner plastic and will be used to sew the fifth embodiment socket connector onto to stuffed toy 28 for a permanent connection.

Figure 19:
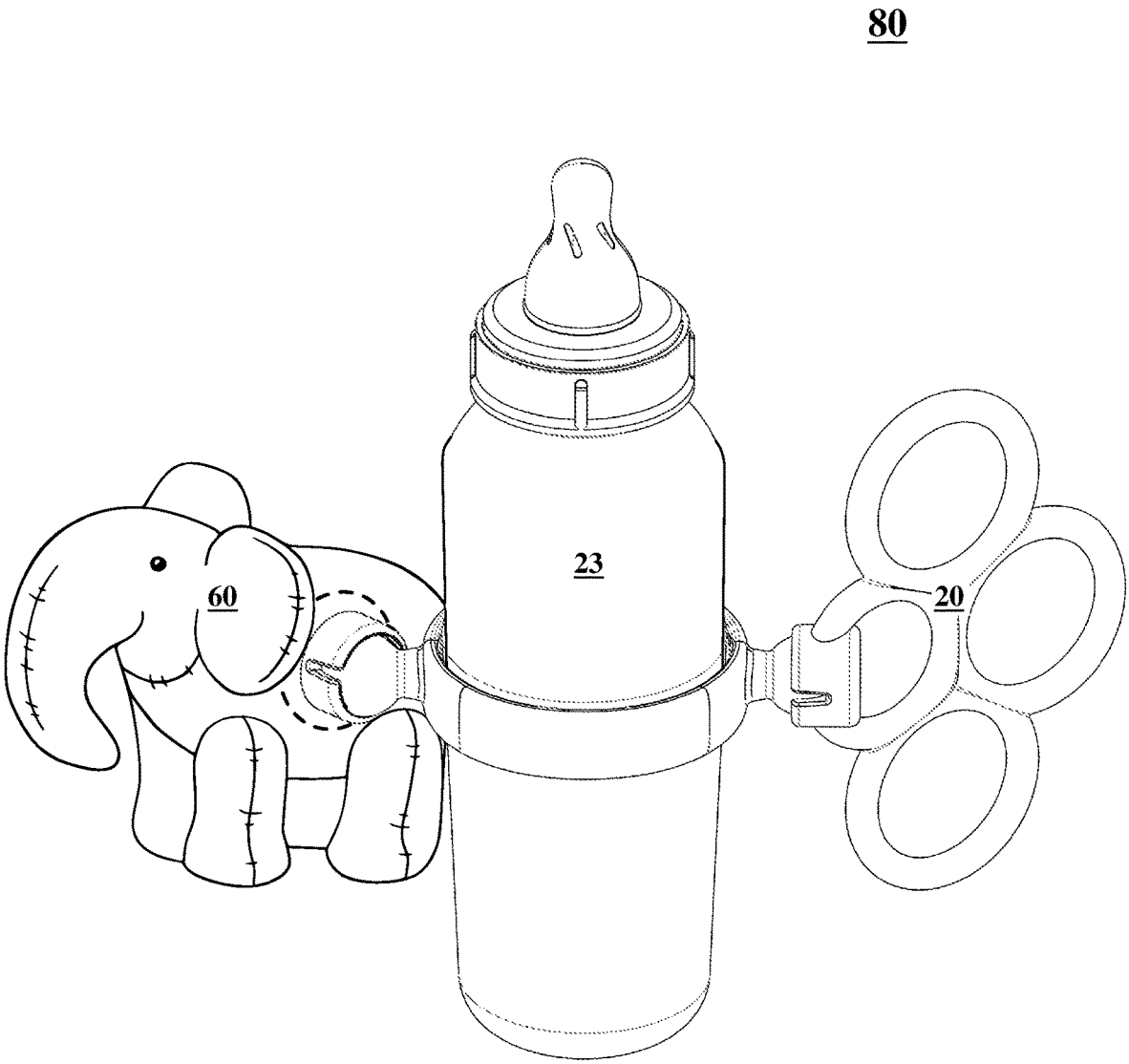
FIG. 19 is a perspective view that illustrates the bottle band FIG. 1 can be joined to the attachment handle from FIG. 4 and from FIG. 14. This represents that any combination of attachment handle embodiments can be joined to FIG. 1.

Lastly, FIG. 19 illustrates the assembled embodiments between 20 and 60, of the present invention, placed on a baby bottle 23 to visualize the interchangeability of the present invention. This is depicted generally by the reference numeral 80.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A device comprising at least one removable handle attachment and/or at least one removable toy attachment for attaching to a baby bottle;

a circumferential band including a plurality of joints positioned along an outer circumference of the circumferential band, each of the plurality of joints to releasably and separately engage the at least one removable handle attachment or the at least one removable toy attachment, the circumferential band having an inner surface to releasably engage the baby bottle;

wherein each joint of the plurality of joints is configured such that the at least one removable handle attachment or the at least one removable toy attachment is simultaneously rotatable through 360 degrees along an x-axis while having limited rotation along both a y-axis and a z-axis about the respective joint;

wherein each joint of the plurality of joints comprises a friction pad for increasing the friction between the respective joint and an opposing joint of the at least one removable handle attachment or the at least one removable toy attachment, the friction pad covering only a distal portion of the joint in part and being positioned on the joint opposite the outer circumference of the circumferential band.

2. The device of claim 1, wherein the band comprises an elastic portion and a rigid plastic portion for supporting each joint of the plurality of joints.

3. The device of claim 2, wherein the band further comprises one or more ribs protruding from the inner surface of the band, the one or more ribs having a lower coefficient of friction than that of the elastic portion of the band.

4. The device of claim 1, wherein a first joint and a second joint of the plurality of joints on the band comprises a ball joint.

5. The device of claim 1, wherein a first joint and a second joint of the plurality of joints are positioned opposite to one another on the band.

6. The device of claim 1, wherein the opposing joint of the at least one removable handle attachment or the at least one removable toy attachment comprises a socket connector.

7. A device comprising at least one removeable handle attachment and/or at least one removeable toy attachment for attaching to a baby bottle, a circumferential band including a plurality of joints positioned along the circumference of the circumferential band, each of the plurality of joints to releasably engage the at least one removable handle attachment or the at least one removable toy attachment, the circumferential band having an inner surface to releasably engage the baby bottle, wherein a first joint and a second joint of the plurality of joints are positioned opposite to one another about the circumferential band;

wherein at least one of the plurality of joints is a ball joint attached to the circumferential band via a conical stem;

wherein the ball joint releasably engaged a socket connector provided on the at least one removeable handle attachment or the at least one removeable toy attachment;

wherein the at least one removable handle attachment and the at least one removable toy attachment are each separately rotatable about the first joint and the second joint;

wherein each of the at least one removable handle attachment and the at least one removable toy attachment are simultaneously rotatable through 360 degrees along an x-axis while having limited rotation along both a y-axis and a z-axis about the respective first joint and the second joint, and, wherein each of the first joint and the second joint comprises a friction pad for increasing the friction between the ball joint and the socket connector, the friction pad covering only a distal portion of the ball joint, in part, and being positioned on the ball joint opposite the conical stem.

8. The device of claim 7, wherein the band further comprises one or more ribs protruding from the inner surface of the band, the one or more ribs having a lower coefficient of friction than that of the elastic portion of the band.

9. An assembly comprising at least one removable attachment for attaching to a baby bottle, the at least one removable attachment selected from a handle or toy;

a device comprising a circumferential band to releasably engage the baby bottle, the circumferential band comprising a plurality of joints positioned along an outer circumference of the circumferential band, each of the plurality of joints configured to releasably engage the at least one removable handle or toy attachment, wherein at least one of the plurality of joints is a ball joint attached to the circumferential band via a conical stem, wherein the ball joint is configured to releasably engage a socket connector provided on the at least one handle or toy attachment;

wherein each of the handle and toy attachments is rotatable about at least one of the plurality of joints;

wherein each joint of the plurality of joints is configured such that the at least one removable handle or toy attachment is simultaneously rotatable through 360 degrees along an x-axis while having limited rotation along both a y-axis and a z-axis about the respective joint; and wherein the ball joint comprises a friction pad for increasing the friction between the ball joint and the socket connector, the friction pad covering only a distal portion of the ball joint, in part, and being positioned on the ball joint opposite the conical stem.

10. The assembly of claim 9, wherein the circumferential band further comprises one or more ribs protruding from an inner surface of the band, the one or more ribs having a lower coefficient of friction than that of the elastic portion of the band.

11. The assembly of claim 9, wherein a first joint and a second joint of the plurality of joints are positioned opposite to one another about the circumferential band.

12. The assembly of claim 9, wherein the handle attachment comprises a plurality of circular gripping arms.

13. The assembly of claim 12, wherein the plurality of circular gripping arms are dimensioned to each receive a finger.

14. The assembly of claim 9, wherein each of the band and the handle attachments is injection molded.

15. The assembly of claim 9, wherein the toy attachment is comprised of:

a stuffed toy; and an opposing joint with a grooved sewing channel, wherein the opposing joint with grooved sewing channel is sewn to the stuffed toy.

16. The assembly of claim 9, wherein the socket connector provided on the at least one handle or toy attachment is provided using an injection molding process.

* * * * *